US007590524B2

(12) United States Patent
Kim

(10) Patent No.: US 7,590,524 B2
(45) Date of Patent: Sep. 15, 2009

(54) METHOD OF FILTERING SPEECH SIGNALS TO ENHANCE QUALITY OF SPEECH AND APPARATUS THEREOF

(75) Inventor: Chan Woo Kim, Gyeonggi-do (KR)

(73) Assignee: LG Electronics Inc., Seoul (KR)

( * ) Notice: Subject to any disclaimer, the term of this patent is extended or adjusted under 35 U.S.C. 154(b) by 720 days.

(21) Appl. No.: 11/221,106

(22) Filed: Sep. 6, 2005

(65) Prior Publication Data

US 2006/0074640 A1 Apr. 6, 2006

(30) Foreign Application Priority Data

Sep. 7, 2004 (KR) ..... 10-2004-0071371

(51) Int. Cl.
*G10L 11/06* (2006.01)

(52) U.S. Cl. ..... 704/208

(58) Field of Classification Search ..... 704/208
See application file for complete search history.

(56) References Cited

U.S. PATENT DOCUMENTS

| | | | | |
|---|---|---|---|---|
| 4,238,746 | A | 12/1980 | McCool et al. | |
| 5,742,694 | A * | 4/1998 | Eatwell | 381/94.2 |
| 5,742,927 | A | 4/1998 | Crozier | |
| 6,597,757 | B2 * | 7/2003 | Ida et al. | 378/34 |
| 7,092,877 | B2 * | 8/2006 | Ribic | 704/228 |
| 2002/0176589 | A1 | 11/2002 | Buck | |

FOREIGN PATENT DOCUMENTS

| | | |
|---|---|---|
| CN | 1201547 | 12/1998 |
| JP | 06-222789 | 8/1994 |
| JP | 1995-239696 | 9/1995 |
| JP | 1995-283860 | 10/1995 |
| JP | 1998-003297 | 1/1998 |
| JP | 1998-003299 | 1/1998 |
| JP | 1999-338499 | 12/1999 |
| JP | 2002-175099 | 6/2002 |
| KR | 1019980024790 | 7/1998 |
| WO | WO 01/59766 A1 | 8/2001 |

OTHER PUBLICATIONS

Lim et al. "Enhancement and bandwidth compression of noisy speech", Proceedings of the IEEE vol. 67 Issue 12, Dec. 1979.
Benesty et al. "Sterephonic acoustic echo cancellation using nonlineartransformations and comb filtering", Proceedings of the 1998 IEEE International Conference on Acoustics, Speec and Signal Processing, vol. 6, May 12-15, 1998.

(Continued)

*Primary Examiner*—Susan McFadden
(74) *Attorney, Agent, or Firm*—Lee, Hong, Degerman, Kang & Waimey

(57) ABSTRACT

The present invention relates to enhancing a quality of speech wherein speech quality degradation is reduced by removing noise from an unvoiced speech. The present invention comprises dividing an input speech into a voiced speech and an unvoiced speech, performing adaptive filtering on the voiced speech to remove a noise of the voiced speech, and performing special subtraction on the unvoiced speech.

18 Claims, 4 Drawing Sheets

OTHER PUBLICATIONS

Chuang et al. "Adaptive two-band spectral subtraction with multi-window spectralestimation", Proceedings of the 1999 IEEE International Conference on Acoustics, Speec and Signal Processing, vol. 2, Mar. 15-19, 1999.

C. D. Yoo et al., "Speech Enhancement Based on the Generalized Dual Excitation Model with Adaptive Analysis Window," Acoustics, Speech, and Signal Processing, 1995, ICASSP-95, International Conference on Detroit, MI, USA May 9-12, 1995, New York, NY, USA, IEEE, US, vol. 1, May 9, 1995, pp. 832-835, XP01062536.

C. He et al. "Adaptive Two-Band Spectral Subtraction with Multi-Window Spectral Estimation," 1999 IEEE International Conference on Acoustics, Speech, and Signal Processing, Phoenix, Arizona, Mar. 15-19, 1999, IEEE International Conference on Acoustics, Speech and Signal Processing (ICASSP), New York, NY, IEEE, US, vol. 2, Mar. 15, 1999, pp. 793-795, XP000900240.

Sasaoka, N., et al., "Smart Noise Reduction System Based on ALE and Noise Reconstruction System," Proceedings of the 2004 International Symposium on Circuits and Systems, vol. 5, pp. V-445 - V-448, May 23, 2004.

* cited by examiner

METHOD OF FILTERING SPEECH SIGNALS TO ENHANCE QUALITY OF SPEECH AND APPARATUS THEREOF

CROSS-REFERENCE TO RELATED APPLICATIONS

Pursuant to 35 U.S.C. § 119(a), this application claims the benefit of earlier filing date and right of priority to Korean Application No. 10-2004-0071371, filed on Sep. 7, 2004, the contents of which is hereby incorporated by reference herein in its entirety.

FIELD OF THE INVENTION

The present invention relates to a method and apparatus for enhancing a quality of speech. Although the present invention is suitable for a wide scope of applications, it is particularly suitable for enhancing the quality of speech effectively.

BACKGROUND OF THE INVENTION

Generally, various kinds of methods for enhancing a quality of speech have been proposed. A spectral subtraction method (SSM) is representative one of the various kinds of methods. The spectral subtraction method (SSM) is explained with reference to FIG. 1 as follows.

The SMM is a method of estimating a short-time spectral magnitude directly. In the SSM, speech is modeled into a form to which a noise, represented by an uncorrelated random variable, is added. The speech modeling is expressed by Formula 1 as follows.

$$y[n]=s[n]+d[n] \quad \text{[Formula 1]}$$

In Formula 1, y[n] is an input speech. Furthermore, it is assumed that d[n] is an uncorrelated noise to s[n]. Hence, power spectral density is found according to Formula 2 as follows.

$$S_y(e^{i\omega})=S_s(e^{i\omega})+S_d(e^{i\omega}) \quad \text{[Formula 2]}$$

In Formula 2, $S_y(e^{j\omega})$ is represented by Formula 3 via a short-time Discrete-Time Fourier Transform (DTFT).

$$S_y(e^{j\omega})=|Y(e^{j\omega})|^2 \quad \text{[Formula 3]}$$

A phase is known to find a spectrum of a speech frame itself. Moreover, it is proven that there is no large difference in determining the phase of the speech frame using a phase of noisy speech that is substantially mixed with noise. D. L. Wang and J. S. Lim, "The unimportance of phase in speech enhancement," IEEE Trans. on Acoust. Speech, and Signal Processing, vol-ASSP. 30, pp. 679-681, 1982.

In case of determining the phase of the speech frame using the phase of the noisy speech, the short-time DTFT to be sought can be found by Formula 4.

$$\hat{S}(e^{j\omega})=|S_y(e^{j\omega})-\hat{S}_d(e^{j\omega})|^{1/2}e^{j\phi_Y(\omega)} \quad \text{[Formula 4]}$$

$S_y(e^{j\omega})$ in Formula 4 is found from Formula 2. And $\phi_y(e^{j\omega})$ uses the phase of the noisy speech. Therefore, an estimated value of ŝ[n] to be sought is found from Formula 4. If there is no speech, $\hat{S}_d(e^{j\omega})$ is estimated from the noise.

One of the various speech quality enhancing methods such as an Adaptive Line Enhancer (ALE) is explained with reference to FIG. 2 as follows. First, use of a general adaptive filter is explained because of the ALE's evolution from a scheme using the adaptive filter.

When using the adaptive filter, after receiving inputs of two microphones, i.e., receiving a noise speech as an input of one microphone and a pure noise as an input of the other microphone, a transfer function and the like are generated due to a distance between the two microphones and the like. However, the adaptive filter removes the transfer function to attain a clean speech.

The method using the adaptive filter is very effective in some cases and has been successfully used for a practical purpose. Yet, the method requires installation of a pair of microphones. Also, there is a structural difficulty in deciding how far the pair of microphones should be spaced apart from each other. Hence, it is difficult to apply the method to a user equipment such as a mobile terminal.

The ALE (Adaptive Line Enhancer) is an improvement of the method employing the adaptive filter and is a scheme for performing adaptive filtering on signals s[n] and d[n] attained from the same microphone by leaving a difference equivalent to a pitch period in between the signals. Here, the pitch period corresponds to a period of a voiced speech part of a speech signal.

For the voiced speech, a periodic impulse train excites a vocal tract. Hence, the ALE exerts a considerable effect on the voiced speech. However, for an unvoiced speech, the corresponding speech is crushed.

One of the various speech quality enhancing methods such as a scheme for using an adaptive comb filter is explained as follows. First, when using an adaptive comb filter, a corresponding scheme similar to the ALE has a better effect on a voiced speech.

In case of the voiced speech, an excitation signal is a periodic signal. Even if a Fourier Transform is performed on an impulse train, the result indicates that the impulse train appears in a frequency domain. Hence, in case of the voiced speech, a peak periodically appears at a portion where a pitch frequency becomes multiple. It is a matter of course that a contour of an overall spectrum is represented by a resonance of a vocal tract called a formant.

When a noisy speech is represented by y[n], a speech is represented by s[n], and the speech of which noise is removed is estimated to be represented by ŝ[n], the speech enhanced by an adaptive comb filter is expressed by Formula 5.

$$\hat{s}[n] = \sum_{i=-L}^{L} c_i y(n - iT_0) \quad \text{[Formula 5]}$$

In Formula 5, $T_0$ represents an extracted pitch period and $c_i$ represents a comb filter coefficient. Here, a small value (1~6) is generally used as a value of L. Meanwhile, since a noise is not generally periodic, the adaptive comb filter is effective in removing the noise. However, the related art speech quality enhancing methods have the following problems or disadvantages.

First, if there is no speech, $\hat{S}_d(e^{j\omega})$ is estimated from the noise in the SSM. However, it is unable to measure the $\hat{S}_d(e^{j\omega})$ reliably. Namely, it is able to estimate the $\hat{S}_d(e^{j\omega})$ only if it is assumed that the noise d[n] is a stationary signal. Even if it is actually so, it is unable to avoid a spectrum variation according to a time. Specifically, in case of a mobile terminal or the like, it is unable to measure the $\hat{S}_d(e^{j\omega})$ reliably since circumferential environments keep changing.

Second, the ALE or the scheme using the adaptive comb filter shows excellent performance on the voiced speech. However, these schemes or methods are applicable to the voiced signal only. In case of applying the ALE or the scheme using the adaptive comb filter to an unvoiced signal, performance is reduced due to a slight misalignment of a voiced/unvoiced (V/UV) decision.

Third, in case of a certain speech, a voiced characteristic appears in a low frequency or an unvoiced characteristic appears in a high frequency, whereby the performance of the ALE is degraded.

SUMMARY OF THE INVENTION

The present invention is directed to enhancing a quality of speech.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the present invention is embodied in a method for enhancing a quality of speech, the method comprising dividing an input speech into a voiced speech and an unvoiced speech, performing adaptive filtering on the voiced speech to remove a noise of the voiced speech, and performing spectral subtraction on the unvoiced speech.

Preferably, the method further comprises performing an adaptive line enhancer process using the adaptive filtering on the voiced speech to remove the noise of the voiced speech. An average value of noise spectrums estimated from prescribed frames corresponding to a previous voiced speech by the adaptive line enhancer process is used for the spectral subtraction. The adaptive filtering uses a pitch period extracted from a frame corresponding to the voiced speech.

In one aspect of the invention, the method further comprises performing at least one of low pass filtering and high pass filtering on the input speech and performing adaptive comb filtering on an output of the high pass filtering to remove a noise of the output. Preferably, the adaptive comb filtering is performed when the output of the high pass filtering corresponds to the voiced speech. In another aspect of the invention, an output of the low pass filtering is divided into the voiced speech and the unvoiced speech.

Preferably, noise spectral data obtained from a section of the voiced speech is used for the spectral subtraction. Furthermore, the noise spectral data is a value resulting from averaging noise spectrums estimated from prescribed frames corresponding to a previous voiced speech by the adaptive filtering.

In accordance with another embodiment of the present invention, an apparatus for enhancing a quality of speech comprises a decision block for dividing an input speech into a voiced speech and an unvoiced speech, an adaptive line enhancer (ALE) block for performing an adaptive line enhancer process on the voiced speech to remove a noise of the voiced speech, and a spectral subtraction (SS) block for performing spectral subtraction on the unvoiced speech.

Preferably, the apparatus further comprises a low pass filter for performing low pass filtering on the input speech to output to the decision block and a high pass filter for performing high pass filtering on the input speech.

In one aspect of the invention the apparatus further comprises an adaptive comb filter for removing a noise from an output of the high pass filter if the output of the high pass filter corresponds to the voiced speech. Preferably, the adaptive comb filter uses a pitch period extracted from the voiced speech.

In another aspect of the invention, the apparatus further comprises a pitch extractor for extracting a pitch period from the voiced speech, wherein the pitch extractor provides the extracted pitch period to the ALE block.

Preferably, the SS block uses a noise spectrum estimated by the ALE block. Furthermore, the SS block uses an average value of noise spectrums estimated from prescribed frames corresponding to a previous voiced speech by the ALE block.

In accordance with another embodiment of the present invention, a method for enhancing a quality of speech comprises receiving an input speech, performing high pass filtering on the input speech, performing adaptive comb filtering on an output of the high pass filtering when the output of the high pass filtering corresponds to a voiced speech, performing low pass filtering on the input speech, performing an adaptive line enhancer process using the adaptive comb filtering on an output of the low pass filtering when the output of the low pass filtering corresponds to the voiced speech, and performing spectral subtraction on the output of the low pass filtering when the output of the low pass filtering corresponds to an unvoiced speech.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. Features, elements, and aspects of the invention that are referenced by the same numerals in different figures represent the same, equivalent, or similar features, elements, or aspects in accordance with one or more embodiments.

DETAILED DESCRIPTION OF THE PREFERRED EMBODIMENTS

The present invention relates to enhancing a quality of speech.

Reference will now be made in detail to the preferred embodiments of the present invention, examples of which are illustrated in the accompanying drawings. Wherever possible, the same reference numbers will be used throughout the drawings to refer to the same or like parts.

In a method of enhancing a quality of speech according to one embodiment of the present invention, a prescribed speech quality enhancing process is performed on a voiced speech and a spectral subtraction method (SSM) is performed on an unvoiced speech using a noise spectrum attained from performing the prescribed speech quality enhancing process.

An apparatus for enhancing a quality of speech in accordance with one embodiment of the present invention is explained with reference to FIG. 3.

Figure 1:
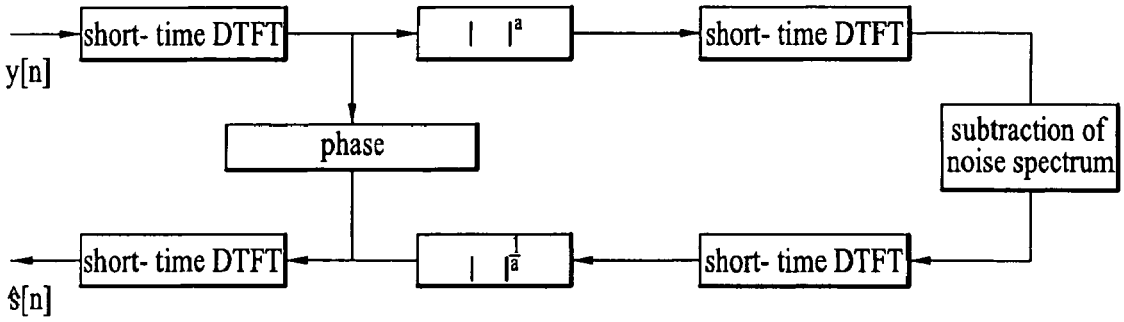
FIG. 1 is a block diagram illustrating a general spectral subtraction method (SSM).
Figure 2:
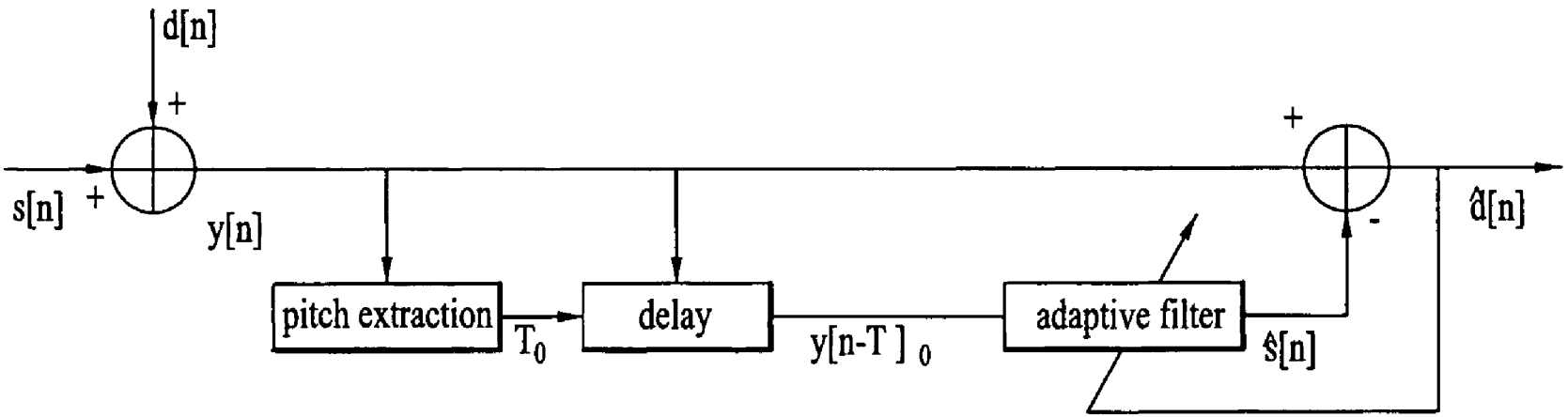
FIG. 2 is a block diagram illustrating a general adaptive line enhancer (ALE).
Figure 3:
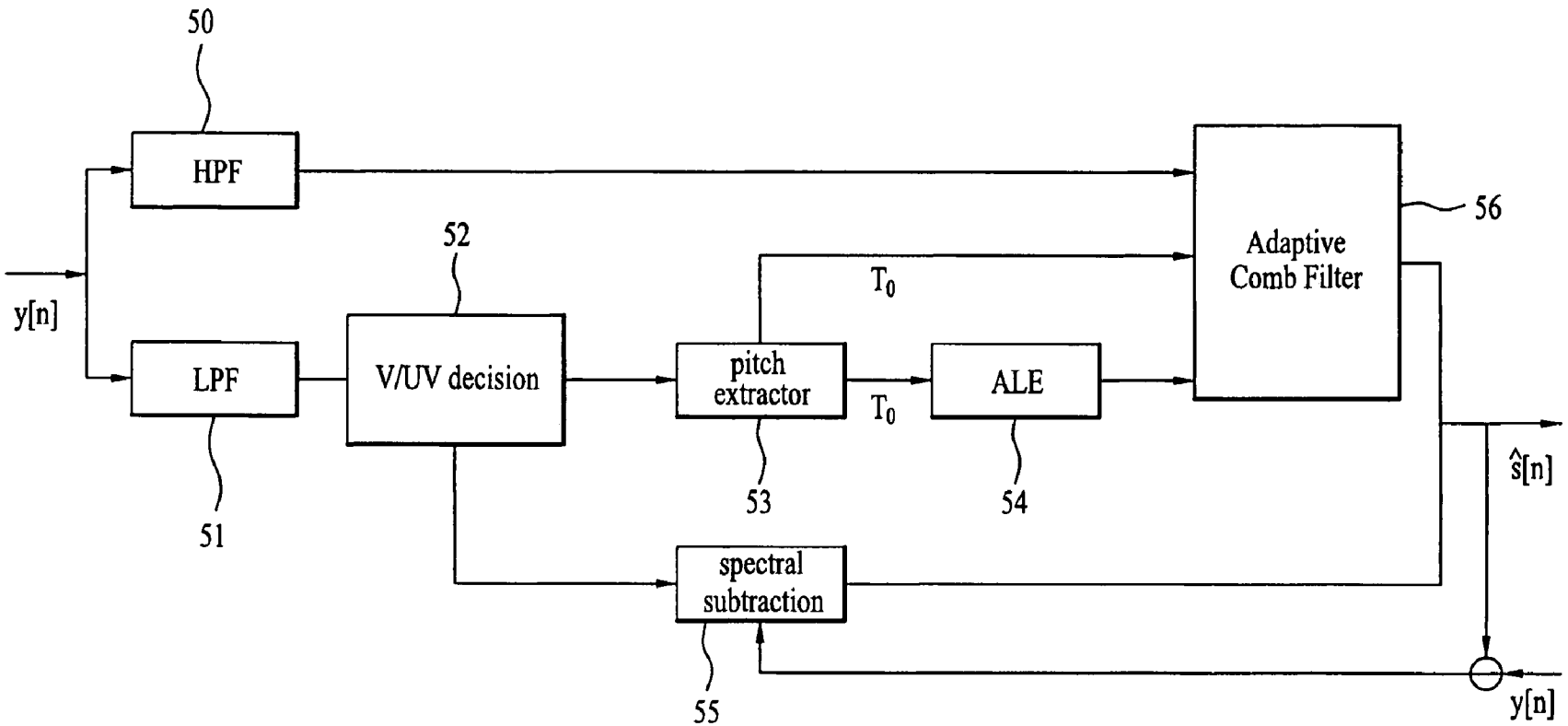
FIG. 3 is a block diagram of an apparatus for enhancing a quality of speech in accordance with one embodiment of the present invention.

Referring to FIG. 3, an apparatus for enhancing a quality of speech comprises a low pass filter (LPF) 51 performing low pass filtering on an inputted speech y[n] and a high pass filter (HPF) 50 performing high pass filtering on the inputted speech y[n].

The apparatus further comprises an adaptive comb filter 56 for processing a high frequency component. The apparatus also comprises a voiced/unvoiced (V/UV) decision block 52, a pitch extractor 53 and a spectral subtraction block 55 to process a low frequency component. Moreover, the apparatus comprises an adaptive line enhancer (ALE) block 54. Alternatively, the ALE block 54 may be replaced by a means for employing a different speech quality enhancing scheme.

An output of the HPF 50 is inputted to an adaptive comb filter 56. An output of the LPF 51 passes through a path using either the ALE or SSM according to a voiced or unvoiced speech. The V/UV decision block 52 decides whether the speech having passed through the LPF 51 corresponds to the voiced or unvoiced speech. It is then decided whether to use the ALE or SSM according to the decision result of the V/UV decision block 52.

Preferably, the V/UV decision block 52 delivers a frame corresponding to the unvoiced speech of the speech having passed through the LPF 51 to the spectral subtraction block 55 using the SSM. Alternatively, a frame corresponding to the voiced speech of the speech having passed through the LPF 51 is delivered to the path using the ALE. The path using the ALE comprises the pitch extractor 53 and the ALE block 54.

The pitch extractor 53 extracts a pitch period $T_0$ from the frame corresponding to the voiced speech and then provides the extracted pitch period $T_0$ to the adaptive comb filter 56. The pitch extractor 53 also provides the extracted pitch period to the ALE block 54, wherein the ALE block 54 uses the pitch period $T_0$ for the ALE to enhance a quality of speech for the frame corresponding to the voiced speech.

As mentioned in the foregoing description, the present invention uses the ALE block 54 as the means for enhancing the quality of speech in accordance with one embodiment of the present invention.

Because a frequency range, within which a pitch frequency exists, corresponds to 50~400 Hz, a cutoff frequency of the LPF 51 is determined to sufficiently include the frequency range and to allow a portion of the speech having the most dominant influence on the pitch period to pass through. Preferably, the cutoff frequency is set to about 800 Hz.

In one embodiment of the present invention, when applying the ALE, the speech having a bandwidth of 0~4 kHz may be obtained by recombination with a range of 400~4,000 Hz. This corresponds to a case having an 8 kHz sampling rate. To prepare for the case, the present invention further uses the adaptive comb filter 56.

The adaptive comb filter 56 of the present invention removes noises lying between portions seeming like an impulse train represented by a pitch component in a high frequency. Preferably, the adaptive comb filter 56 operates if a clear signal corresponding to the voiced speech exists in the high frequency component.

Meanwhile, the spectral subtraction block 55 employing the SSM uses noise spectral data obtained from a section of the voiced speech. Preferably, the spectral subtraction block 55 uses a value resulting from averaging noise spectrums estimated in a prescribed frame of the previous voiced speech. In other words, the noise spectral data is obtained from averaging noise spectrum data sequences of a predetermined number of frames each time the noise spectrum is obtained from the voiced speech. Therefore, the speech ŝ[n] can be obtained in a manner of removing noises from the outputs of the spectral subtraction block 55 and the adaptive comb filter 56.

Figure 4:
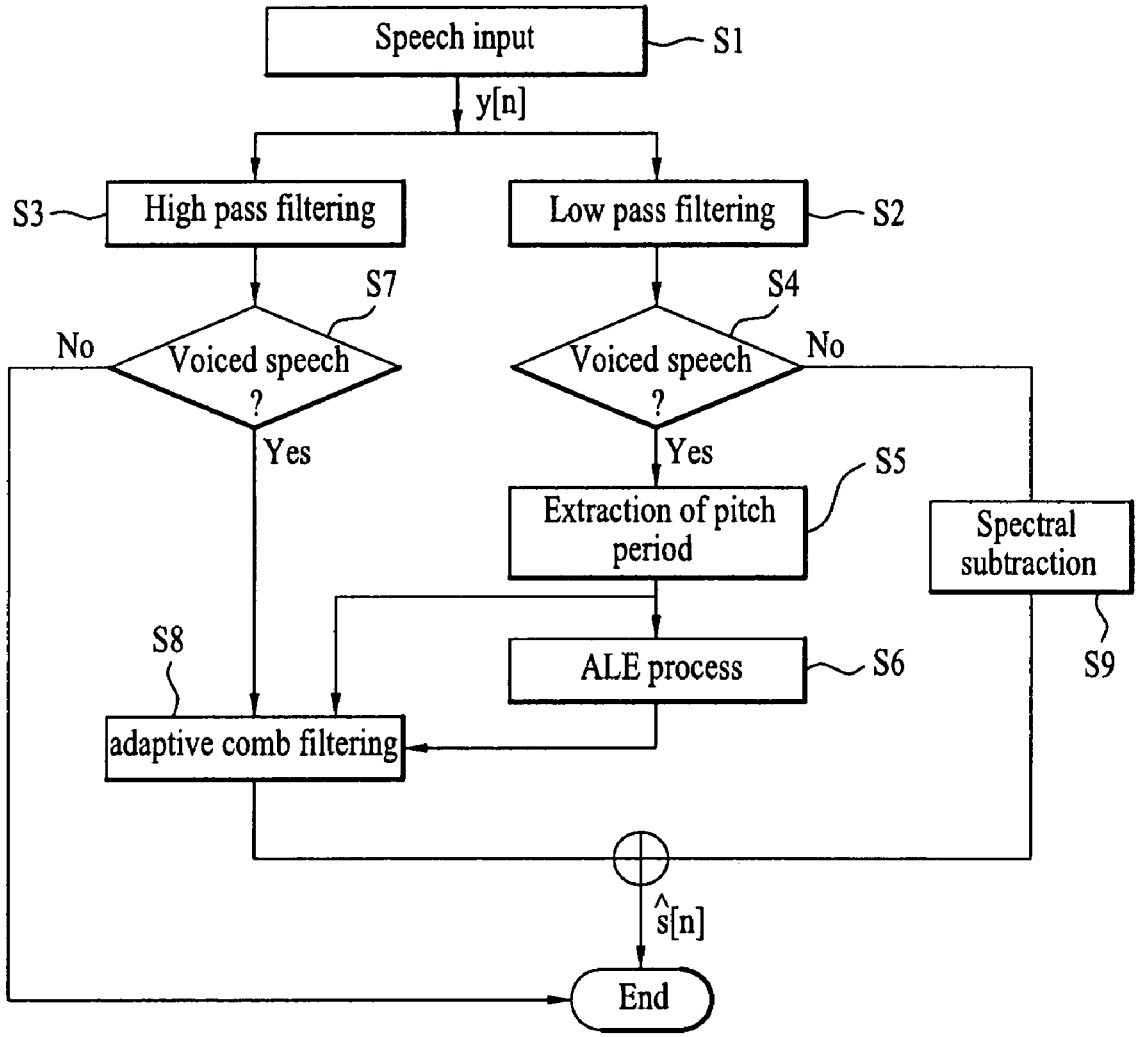
FIG. 4 is a flow diagram illustrating a method for enhancing a quality of speech in accordance with one embodiment of the present invention.

FIG. 4 is a block diagram of a method for enhancing a quality of speech in accordance with one embodiment of the present invention. Referring to FIG. 4, once a prescribed speech y[n] is inputted (S1), low pass filtering (S2) and high pass filtering (S3) are carried out on the inputted speech y[n].

A frequency range, in which a pitch frequency exists, is generally 50~400 Hz. Accordingly, a portion of the speech, which sufficiently includes the frequency range and which has the most dominant influence on a pitch period, undergoes low pass filtering. Preferably, a cutoff frequency of the low pass filtering is set to about 800 Hz.

Subsequently, it is identified whether an output of the low pass filtering corresponds to a voiced speech or an unvoiced speech (S4). If the output of the low pass filtering corresponds to the voiced speech, a prescribed speech quality enhancing method is carried out on a frame corresponding to the voiced speech. Preferably, ALE is used as the speech quality enhancing method for the voiced speech. Hence, an ALE process is carried out on the frame corresponding to the voiced speech (S6).

Prior to the ALE process, it is a matter of course that a pitch period is extracted from the frame corresponding to the voiced speech (S5). The extracted pitch period is used for adaptive comb filtering (S8) as well as for the ALE process (S6).

However, if the output of the low pass filtering corresponds to the unvoiced speech, spectral subtraction is carried out on a frame corresponding to the unvoiced speech (S9). In carrying out the spectral subtraction, a value obtained from averaging noise spectrums estimated from a prescribed frame of the previous voiced speech by the ALE process is used. Preferably, a value obtained from averaging noise spectrum data sequences of a predetermined number of frames each time a noise spectrum is obtained from the voiced speech by the ALE process is used. The corresponding value is the noise spectral data obtained from the voiced speech.

Adaptive comb filtering is carried out on an output resulting from performing high pass filtering on the inputted speech y[n] to remove noise of the output (S8). In doing so, the pitch period extracted from the voiced speech of the output from the low pass filtering (S5) is used in carrying out the adaptive comb filtering. However, prior to the adaptive comb filtering, it is decided whether the output from the high pass filtering corresponds to the voiced speech (S7). If a clear signal corresponding to the voiced speech exists, the adaptive comb filtering is carried out.

Therefore, the speech ŝ[n] can be obtained in a manner of removing noises from the results of the spectral subtraction and the adaptive comb filtering. According to the above-described present invention, performance better than that of the ALE or SSM is expected.

In the present invention, after the ALE is performed on the low frequency component having the strong pitch characteristic, the adaptive comb filter is further used when the high frequency component corresponds to the voiced speech. Hence, the present invention provides effective performance if the low and high frequencies have the voiced and unvoiced characteristics, respectively.

Because the quality of speech is enhanced based on the pitch characteristic, which is the generic characteristic of the speech, the present invention is more tenacious against babble noise and the like than other speech quality methods (e.g., Wiener filtering, spectral subtraction method). Accordingly, the present invention is useful for noise removal using a single microphone of a mobile terminal and for noise removal when recording speech with a portable recorder. The present invention is further useful for noise removal in a general wire/wireless phone or for recording speech in a PDA or the like.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structure described herein as performing the recited function and not only structural equivalents but also equivalent structures.

What is claimed is:

1. A method for enhancing a quality of a speech signal, the method comprising:

performing low pass filtering on an input speech signal in a low pass filter;

receiving the low-pass filtered input speech signal in a decision module and dividing the low-pass filtered input speech signal into a voiced speech signal and an unvoiced speech signal;

receiving the voiced speech signal in an adaptive filtering module and performing adaptive filtering on the voiced speech signal to remove a noise of the voiced speech signal; and receiving the unvoiced speech signal in a spectral subtraction module and performing spectral subtraction on the unvoiced speech signal.

2. The method of claim 1, further comprising performing an adaptive line enhancing process using the adaptive filtering module on the voiced speech signal to remove the noise of the voiced speech signal.

3. The method of claim 2, wherein an average value of noise spectrums estimated from prescribed frames corresponding to a previous voiced speech signal by the adaptive line enhancing process is used for the spectral subtraction.

4. The method of claim 1, wherein the adaptive filtering uses a pitch period extracted from a frame corresponding to the voiced speech signal.

5. The method of claim 1, further comprising performing high pass filtering on the input speech signal in a high pass filter.

6. The method of claim 5, further comprising performing adaptive comb filtering on an output of the high pass filter to remove a noise of the output.

7. The method of claim 6, wherein the adaptive comb filtering is performed when the output of the high pass filter corresponds to a voiced speech signal.

8. The method of claim 1, wherein noise spectral data obtained from a section of the voiced speech signal is used for the spectral subtraction.

9. The method of claim 8, wherein the noise spectral data is a value resulting from averaging noise spectrums estimated from prescribed frames corresponding to a previous voiced speech signal by the adaptive filtering.

10. A method for enhancing a quality of a speech signal, the method comprising:

receiving an input speech signal in a high pass filter and performing high pass filtering on the input speech signal;

receiving an output of the high pass filter in an adaptive comb filter and performing adaptive comb filtering on the output of the high pass filter when the output of the high pass filter corresponds to a voiced speech signal;

receiving the input speech signal in a low pass filter and performing low pass filtering on the input speech signal;

receiving an output of the low pass filter in an adaptive line enhancer and performing an adaptive line enhancing process using the adaptive comb filter on the output of the low pass filter when the output of the low pass filtering corresponds to the voiced speech signal; and receiving the output of the low pass filter in a spectral subtraction module and performing spectral subtraction on the output of the low pass filter when the output of the low pass filter corresponds to an unvoiced speech signal.

11. An apparatus for enhancing a quality of a speech signal, comprising:

a low pass filter performing low pass filtering on an input speech signal;

a decision module receiving the low-pass filtered input speech signal and dividing the low-pass filtered input speech signal into a voiced speech signal and an unvoiced speech signal;

an adaptive line enhancer (ALE) module receiving the voiced speech signal and performing an adaptive line enhancing process on the voiced speech signal to remove a noise of the voiced speech signal; and a spectral subtraction (SS) module receiving the unvoiced speech signal and performing spectral subtraction on the unvoiced speech signal.

12. The apparatus of claim 11, further comprising:

a high pass filter performing high pass filtering on the input speech signal.

13. The apparatus of claim 12, further comprising an adaptive comb filter removing a noise from an output of the high pass filter if the output of the high pass filter corresponds to a voiced speech signal.

14. The apparatus of claim 13, wherein the adaptive comb filter uses a pitch period extracted from the voiced speech signal.

15. The apparatus of claim 11, further comprising a pitch extractor for extracting a pitch period from the voiced speech signal.

16. The apparatus of claim 15, wherein the pitch extractor provides the extracted pitch period to the ALE module.

17. The apparatus of claim 11, wherein the SS module uses a noise spectrum estimated by the ALE module.

18. The apparatus of claim 11, wherein the SS module uses an average value of noise spectrums estimated from prescribed frames corresponding to a previous voiced speech signal by the ALE module.

* * * * *